United States Patent [19]

Yokosuka

[11] Patent Number: 4,539,736

[45] Date of Patent: Sep. 10, 1985

[54] BUCKLE FOR A WATCH BAND

[75] Inventor: Koichi Yokosuka, Tokyo, Japan

[73] Assignee: Seiko Instruments & Electronics Ltd., Tokyo, Japan

[21] Appl. No.: 299,529

[22] Filed: Sep. 4, 1981

[30] Foreign Application Priority Data

Sep. 29, 1980 [JP] Japan ..... 55-138625

[51] Int. Cl.[3] ..... A44B 11/25

[52] U.S. Cl. ..... 24/644; 24/241 R; 24/265 WS; 24/702

[58] Field of Search ..... 24/201 R, 201 A, 71 L, 24/241 R, 265 WS

[56] References Cited

U.S. PATENT DOCUMENTS

| | | | |
|---|---|---|---|
| 244,475 | 7/1881 | Orcutt | 24/201 A |
| 317,984 | 5/1885 | Essig | 24/201 A |
| 534,165 | 2/1895 | Lee | 24/201 A |
| 759,683 | 5/1904 | Dreisbach | 24/618 |
| 1,467,465 | 9/1923 | Wiedmann | 24/201 R |
| 1,704,422 | 3/1929 | Belunes | 24/201 A |
| 1,998,406 | 4/1935 | Gouverneur | 24/201 A |
| 2,074,035 | 3/1937 | Ward | 24/201 A |
| 2,346,887 | 4/1944 | Winkler | 24/201 R |
| 2,503,570 | 4/1950 | Vogel | 24/201 R |
| 3,200,461 | 8/1965 | Miller | 24/201 A |
| 3,404,440 | 10/1968 | Weiss | 24/241 R |
| 4,052,774 | 10/1977 | Noda | 24/575 |
| 4,161,806 | 7/1979 | Hennisse et al. | 24/618 |
| 4,359,808 | 11/1982 | Fontaine | 24/265 WS X |

FOREIGN PATENT DOCUMENTS

| | | | |
|---|---|---|---|
| 634177 | 11/1927 | France | 24/68 J |
| 35922 | 2/1906 | Switzerland | 24/230 BC |
| 262362 | 6/1949 | Switzerland | 24/588 |
| 409873 | 5/1934 | United Kingdom | 24/590 |
| 1223120 | 2/1971 | United Kingdom | 24/647 |

*Primary Examiner*—William E. Lyddane
*Assistant Examiner*—Peter A. Aschenbrenner
*Attorney, Agent, or Firm*—Robert E. Burns; Emmanuel J. Lobato; Bruce L. Adams

[57] ABSTRACT

A buckle for a watch band comprising a stopper fixture slidably mounted on one end of a band and a linking member fixed to the other end of the band to join to said stopper fixture. The stopper fixture includes a pair of side plates, a bottom plate and a top plate. The top plate is provided with a joint opening in the shape of a wide opening connected to a narrow opening in the direction of the band. The stopper fixture has an inverted L-shaped step portion formed at the edge and under the border portion of the wide opening and the narrow opening, said linking member is substantially in the shape of the joint opening of the stopper fixture and provided with a linking tongue of a thickness to engage the step portion, and an upper rotatable cover to cover the engaged combination of the linking tongue and the joint opening, and the under surface of said upper cover is provided with a protruding member dimensioned and positioned to be pressed into the clearance formed when the linking tongue is disposed in the joint opening and slides in the band direction to engage the step portion.

22 Claims, 2 Drawing Figures

BUCKLE FOR A WATCH BAND

BACKGROUND OF THE INVENTION

The present invention relates to a buckle for a watch band, and more particularly to what is called a freely adjustable band tail lock in which the band fixed to both sides of a watch case can be separated at the buckle portion.

Generally, a mesh band is employed for this type of band. The mesh band is made in one body with a watch case by brazing, and an end of the band is cut off according to the user's wrist size, and a removable buckle is mounted on the end of the band. However, since the buckle has a plurality of linking axes and axes to fix to the band, it is several times as thick as the band.

SUMMARY OF THE INVENTION

Accordingly, it is an object of the present invention to eliminate the above-noted drawbacks and provide a buckle for a watch band, in which the length of one band end is fixed and the other band end is provided with a slidable stopper fixture to permit adjustment the length of the band. The length of the band can be adjusted without cutting off the end thereof and the thickness of which can be greatly reduced.

DETAILED DESCRIPTION OF THE INVENTION

Hereinafter the present invention will be described in conjunction with the drawings.

Figure 1:
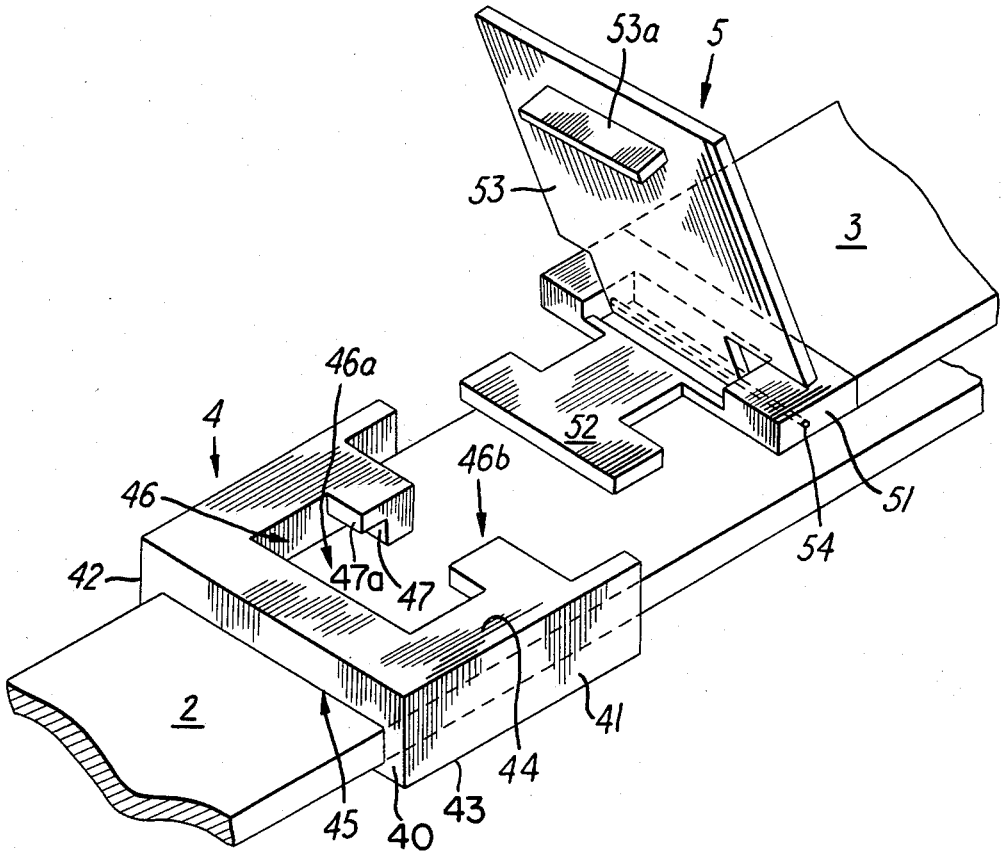
FIG. 1 shows a perspective view of a buckle for a wrist watch band according to the present invention.
Figure 2:
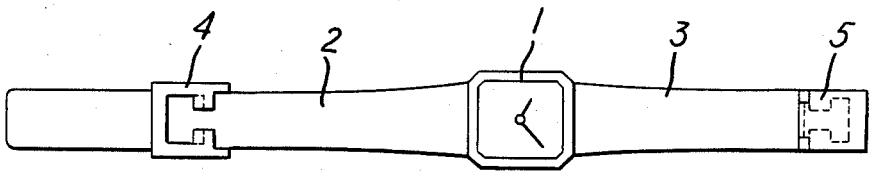
FIG. 2 shows a plan view of a watch case and band provided with a buckle according to the present invention.

FIG. 1 shows a perspective view of a buckle for a watch band according to the present invention, and FIG. 2 shows a plan view of a watch case and band provided with a buckle. In the figure, reference numeral 1 denotes a watch case body, 2 denotes one band fixed to the watch case body 1, and 3 denotes the other band. The band 2 is for adjusting the overall length of the band and the band 3 is of a fixed length. A first buckle member in the form of a stopper fixture 4, for adjusting the length of the band 2 according to the user's wrist size, is slidably mounted on the band 2. The stopper fixture 4 is comprised of a pair of opposed side plates 41 and 42, an end side plate 40 extending between the two side plates 41 and 42, a bottom plate 43 and a top plate or top plate 44, and the band 2 passes through a hand-receiving opening or through hole 45 formed in the end side plate 40 between the upper surface or lever of the bottom plate 43 and the lower surface or lever of the top plate 44 as shown in FIG. 1. The stopper fixture 4 is slidable along the band 2, and although not shown, the stopper fixture 4 is fixed to the band 2 by a plurality of screws screwed on the bottom plate 43.

The top or ceiling plate 44 is provided with a joint opening 46 comprised of a wide opening part **46*a* and a narrow opening part 46*b* and opened to one side of the ceiling plate. While the joint opening 46 is of T-shape in this embodiment as shown, it is to be noted that the shape may be modified without departing from the scope and spirit of the invention. The ceiling plate 44 is provided with an inverted ⅂ or shaped step wall portion 47 inside the lower surface thereof. The two sides plates 41 and 42, end side plate 40, bottom plate 43 and top plate 44 define a recess within the buckle member 4. The opening 46 formed in the top plate 44 opens into the recess and permits access to the recess from above. As shown in the drawing, the wall portion 47 has an overhanging part 47*a*** which extends over a part of the recess to restrict the size of the entrance to the recess as viewed in a downward direction from vertically above.

A second buckle member in the form of a linking member 5 to releasably link to the stopper fixture 4 is fixed to the other end of the band 3. The linking member 5 is comprised of a fixed member 51 fixed to the band 3, a linking tongue 52 fixed to the fixed member 51 and an upper cover 53 rotatably or turnable fixed to the fixed member 51. The fixed member 51 is comprised of a "]" shaped or bracket-shaped fixture and fixed to one end of the band 3 by brazing or the like. The linking tongue 52 is of the shape which substantially conforms to the joint opening 46 of the stopper fixture 4, and is dimensioned to be inserted downwardly into the joint opening 46 from vertically above and slid in the horizontal direction to fit into and engage with the "⅂" shaped step wall portion 47, so that the tongue 52 underlies the overhanging part **47*a* and the bottom portion is fixed to the "]" shaped opening of the fixed member 51 in one body. The upper cover 53 which covers the linking tongue 52 is formed of a plate to overlay the top or ceiling plate 44 of the stopper fixture 4 on top thereof, and the bottom portion of the upper cover 53 is rotatably or turnably fixed by way of an axial pin 54 or the like mounted on the "]" shaped portion of the fixed member 51. The under surface of the upper cover 53 is provided with a protruding member 53*a*. The protruding member 53*a* is pressed into and engaged with one side of the joint opening 46 of the stopper fixture 4 corresponding to the clearance formed when the linking tongue 52 is disposed within to the joint opening 46** and slidably moved to engage with the "⅂" shaped step portion.

The operation of the buckle for a watch band according to the present invention is as follows.

The stopper fixture 4 is slidably positioned and fixed to the band 2 according to the user's wrist size, then the linking tongue 52 of the linking member 5 is moved forwardly toward the stopper fixture 4 and is inserted in to the joint opening 46 of the stopper fixture 4 and slidably displaced rearwardly in the horizontal direction to engage with the "⅂" shaped step wall portion 47 which restricts the vertical movement of the linking tongue 52, and then the upper cover 53 is closed. When this occurs the protruding member **53*a* of the upper cover 53 is inserted into the clearance formed when the linking tongue 52 is disposed within the wide opening 46*a* of the joint opening 46 and displaced horizontally, and thereby the vertical movement of the linking tongue 52 is restricted and the bands 2 and 3 are completely and securely joined. As can be seen from FIG. 1, the stopper fixture member 4 and the linking member 5 are kept orientated in the same orientation as shown in FIG. 1 while the linking tongue 52 is introduced from above into the wide opening part 46*a* of the opening 46, and it is not necesary to twist or tilt the two buckle member 4,5 to close or open the buckle. The stopper fixture 4 and the linking member 5 may be made not only of metals but also of sythetic resins such as plastics or the like. While the stopper fixture 4 is slidably mounted on the band 2, it is to be noted that it may be fixed to the end of the band 2 in one body by brazing, adhering or the like after the length of the band is determined. In this case, the stopper fixture 4 does not necessitate the through hole 45 of the band 2. So that if the linking member 5 is inserted within the joint opening 46, the bands 2 and 3** do not overlap each other, and consequently, a tail lock having substantially the same thickness as the band is realized.

As illustrated, since the linking tongue 52 is disposed within to and slides horizontally to the joint opening 46 according to the present invention, the buckle is not removed while the user wears the watch, and the joint axes and pins are not needed. Further an exceedingly thin tail lock, which is twice as thick as the band, is realized. Further the length of the band can be freely adjusted without cutting off the end thereof.

I claim:

1. A buckle for a watchband comprising: a stopper fixture slidably mounted on one end of a band; and a linking member fixed to the other end of the band to join to said stopper fixture, wherein said stopper fixture includes a pair of side plates, a bottom plate and a top plate, said top plate having a joint opening in the shape of a wide opening connected to a narrow opening in the direction of the band, said stopper fixture having an inverted L-shaped step portion formed at the edge and under the border portion of the wide opening and the narrow opening, said linking member being substantially in the shape of the joint opening of the stopper fixture and having a linking tongue of a thickness to engage said step portion, and an upper rotatable cover to cover the engaged combination of the linking tongue and the joint opening, the under surface of said upper cover having a protruding member dimensioned and positioned to be pressed into the clearance formed when the linking tongue is disposed in the joint opening and slides in the band direction to engage said step portion.

2. A buckle for adjustable attachment to a watchband comprising: a first buckle member having a top portion, a bottom portion, two opposed side portions extending between the top and bottom portions, and an end side portion extending between the top and bottom portions and between the two side portions, means defining a recess in the first buckle member, the recess being defined by the top, bottom, two side and end side portions, the top portion having an opening which opens into the recess to permit access to the recess from above, the opening having a wider part and a narrower part with the wider part being disposed closer to the end side portion than the narrower part, a wall portion disposed opposite the end side portion and having an overhanging part which extends over a part of the recess to restrict the size of the entrance to the recess from above, the means defining a band-receiving opening in the end side portion, the band-receiving opening being located in the end side portion above the level of the bottom portion and below the level of the top portion and being dimensioned to enable slideable insertion of the watchband therein during use of the buckle so that the watchband extends into the recess and overlies the bottom portion whereby the position of the watchband can be slidably adjusted relative to the first buckle member; and a second buckle member for attachment to a watchband end and being releasably engageable with the first buckle member, the second buckle member having a tongue, the tongue having an end portion which generally conforms in shape to the entrance to the recess of the first buckle member to enable the tongue to be introduced from above into the recess, the tongue having a thickness effective to permit the tongue to be displaced within the recess to a position in which the tongue at least partly underlies the overhanging part of the first buckle member wall portion thereby preventing withdrawal of the tongue from the recess, a cover turnably mounted on the second buckle member for movement between an open position in which the cover is clear from the top portion of the first buckle member and a closed position in which the cover rests on and effectively covers the top portion of the first buckle member, and locking means for releasably locking the tongue within the recess thereby releasably locking together the first and second buckle members, the locking means comprising a protrusion extending from the cover, the protrusion being dimensioned and positioned to extend into the top portion opening and releasably engage with the top portion of the first buckle member when the cover is in the closed position so as to prevent movement of the tongue and thereby maintain the tongue partly underlying the overhanging part of the first buckle member.

3. A buckle according to claim 1; wherein the wall portion is spaced from the bottom portion a distance sufficient to permit the watchband to slidably extend therebeneath.

4. A buckle according to claim 3; wherein the overhanging part of the wall portion and the top portion comprise a single platelike member.

5. A buckle according to claim 3; wherein the wall portion comprises a pair of wall portion sections connected to respective ones of the two side portions and being separated by the narrower part of the top portion opening.

6. A buckle according to claim 1; wherein the overhanging part of the wall portion and the top portion comprise a single platelike member.

7. A buckle according to claim 1; wherein the wall portion comprises a pair of wall portion sections connected to respective ones of the two side portions and being separated by the narrower part of the top portion opening.

8. A buckle for a watchband comprising: first and second buckle members having an open condition in which the buckle members are spaced apart from one another and the second buckle member being movable in a forward direction toward the first buckle member to a closed condition in which the buckle members are releasably secured together; the first buckle member having a recess, and a step wall portion having a first wall portion which bounds a part of the recess and a second wall portion which extends in the forward direction and overlies a part of the recess; the second buckle member having a tongue, and a movable cover movable to a closed position to overlie the tongue; the second buckle member being configured so as to be movable in the forward direction toward the first buckle member to enable the tongue to be introduced into said recess and then movable in the reverse direction to a position in which the tongue engages the said first wall portion and at least partly underlies the said second wall portion so as to leave a part of the recess unoccupied by the tongue, the cover being configured so as to then be movable into and out of its closed position above a corresponding surface of the first buckle member and being effective when in the closed position to prevent withdrawal of the tongue from under the second wall portion, the cover having a portion which is releasably engageable with a part of the first buckle member to releasably hold the cover in said closed position and prevent movement of the tongue in the forward direction when the cover is in said closed position; whereby the first and second buckle members are releasably secured together.

9. A buckle as claimed in claim 8; in which the said cover portion comprises a protrusion protruding from the cover and positioned to be disposed in the said unoccupied part of the recess when the cover is in the closed position.

10. A buckle as claimed in claim 8; in which the first buckle member has a through hole dimensioned to permit a watchband to be inserted therein into the recess so as to enable the first buckle member to slide along the watchband to a desired position, the first buckle member having means for releasably securing the first buckle member to the watchband in said desired position.

11. A buckle as claimed in claim 8; in which both the said recess and the tongue have similarly shaped relatively wide and relatively narrow portions.

12. A buckle as claimed in claim 8; in which the cover is turnably mounted on the second buckle member.

13. A buckle as claimed in claim 12; including a spring rod for turnably mounting the cover on the second buckle member.

14. A buckle for a watchband or the like comprising: first and second buckle members having an open condition in which the buckle members are spaced apart and disengaged from one another and being movable toward and releasably engageable with one another to define the normal closed condition of the buckle, the first and second buckle members having a predetermined orientation relative to each other when in the normal closed condition; the first buckle member having means therein defining a recess, and wall means overlying a part of the recess to restrict the size of the entrance to the recess from above; the second buckle member having a tongue dimensioned to be introduced from above into the recess when the second buckle member is moved in a forward direction toward the first buckle member with the buckle members in said predetermined orientation and being slidable backwardly in the recess in a direction opposite to the forward direction to a position in which the tongue at least partly underlies the wall means thereby preventing withdrawal of the tongue from the recess, and a movably mounted cover movable between an open position in which the cover does not cover the recess thereby permitting sliding movement and withdrawal of the tongue from the recess and a closed position in which the cover effectively covers the recess and maintains the tongue at least partly underlying the wall means so as to prevent withdrawal of the tongue from the recess; and means on the cover of the second buckle member coacting with means on the first buckle member for releasably holding the cover in its closed position and preventing sliding movement of the tongue in the forward direction when the cover is in its closed position.

15. A buckle according to claim 14; wherein the means on the cover of the second buckle member comprises a protrusion connected to the underside of the cover, the protrusion being configured and disposed so as to protrude into the recess in a clearance formed therein when the tongue slides to at least partly underlie the wall means; and the means on the first buckle member comprises means coacting with the protrusion to releasably hold the cover in its closed position.

16. A buckle according to claim 14; wherein the means on the cover of the second buckle member comprises a protrusion connected to the underside of the cover and releasably engageable with the means on the first buckle member to releasably hold the cover in its closed position.

17. A buckle according to claim 14; wherein the recess has a relatively wide portion along a part of which extends said wall means which overlies a part of the recess wide portion, and a relatively narrow portion; and wherein the tongue has relatively wide and relatively narrow portions dimensioned to enable the tongue to be moved downwardly from above into the recess and to be moved horizontally in the recess to a position in which the tongue wide portion at least partly underlies the wall means.

18. A buckle according to claim 17; wherein the wall means comprises an overhanging wall portion which overhangs a part of the recess wide portion.

19. A buckle according to claim 17; wherein the recess and the tongue each have a generally T-shaped configuration.

20. A buckle according to claim 14; wherein the first buckle member includes means defining a band-receiving opening which opens into the recess and which is dimensioned to permit a watchband to be slidably inserted therein into the recess to thereby enable the position of the watchband to be slidably adjusted relative to the first buckle member.

21. A buckle according to claim 20; wherein the band-receiving opening extends completely through the first buckle member to permit the watchband to be slidably inserted completely through the first buckle member.

22. A buckle according to claim 20; wherein the band-receiving opening extends beneath the wall means to permit the watchband to be slidably inserted into the recess and beneath the wall means.

* * * * *